United States Patent [19]

Simon et al.

[11] Patent Number: 4,520,063

[45] Date of Patent: May 28, 1985

[54] FORGERY-PROOF FLAT ARTICLE OF A SYNTHETIC RESIN, AND PROCESS FOR THE PRODUCTION THEREOF

[75] Inventors: Manfred Simon, Niederkassel; Karl-Heinz Spiess, Much-Schwellenbach; Richard Weiss, Troisdorf, all of Fed. Rep. of Germany

[73] Assignee: Dynamit Nobel Aktiengesellschaft, Troisdorf, Fed. Rep. of Germany

[21] Appl. No.: 400,006

[22] Filed: Jul. 20, 1982

[30] Foreign Application Priority Data

Jul. 25, 1981 [DE] Fed. Rep. of Germany ..... 3129400

[51] Int. Cl.[3] ..... D06P 5/02

[52] U.S. Cl. ..... 428/195; 428/199; 427/7; 156/277; 156/278; 8/484

[58] Field of Search ..... 428/195, 199; 156/277, 156/278; 427/7

[56] References Cited

U.S. PATENT DOCUMENTS

| | | | |
|---|---|---|---|
| 3,847,644 | 11/1974 | Erhardt et al. | 428/199 X |
| 4,054,704 | 10/1977 | Vassiliou | 428/199 X |
| 4,064,303 | 12/1977 | Vassiliou | 428/199 X |
| 4,068,030 | 1/1978 | Witman | 156/277 X |
| 4,248,922 | 3/1981 | Shortway et al. | 156/277 X |
| 4,284,453 | 8/1981 | Endrizzi | 156/278 X |
| 4,297,099 | 10/1981 | Simon et al. | 8/484 |
| 4,337,289 | 6/1982 | Reed et al. | 428/199 X |

*Primary Examiner*—George F. Lesmes

*Assistant Examiner*—Nancy A. B. Swisher

*Attorney, Agent, or Firm*—Antonelli, Terry & Wands

[57] ABSTRACT

A forgery-proof flat article, for example, for the production of banking cards, credit cards, and the like, is provided with a security feature analogous to a watermark and is made of thermoplastic and elastomeric synthetic resins based on transparent, translucent, or colored sheets made by extrusion, calendering, blow-molding, or spread coating, or composite sheets therefrom, with an application of a colorant, capable of migrating, to the surface in the presence of a crosslinkable component in the flat article and/or in the colorant application. The colorant application, upon reaching the desired migration depth of the applied colorant, is fixed in the flat article by a crosslinking reaction. This flat article, by the use of two differently quickly migrating colorants, has a coloring showing on both sides of the flat article the security feature in congruence, this security feature appearing on the topside in the color of the more rapidly migrating colorant and, when the article is viewed while held up to the light, appearing in the form of the mixed color.

Special effects are obtained in one embodiment of a composite flat article wherein one sheet side, treated with two different colorants, is bonded by laminating to a further sheet. After penetration of the colorants and fixation, the security feature is visible on both sides of the sheet and recognizable in the mixed color when the article is held up to the light and viewed in this way.

8 Claims, 1 Drawing Figure

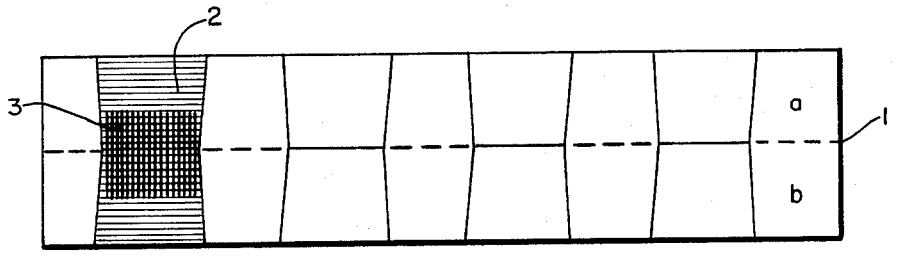
2
3
a
b
1

FORGERY-PROOF FLAT ARTICLE OF A SYNTHETIC RESIN, AND PROCESS FOR THE PRODUCTION THEREOF

This invention relates to a forgery-proof flat article formed of a synthetic resin and a process for the production thereof.

Credit cards, banking cards, ID cards, drawings or the like, produced on the basis of flat synthetic resin material are, in spite of various safety precautions, not sufficiently safe from unauthorized imitation or subsequent alteration.

Moreover, in the packaging sector, it could be advantageous to utilize a packaging sheet making imitation difficult. Furthermore, use is contemplated, in particular, in case of records, music cassettes, pharmaceuticals, or perfumery articles which are imitated increasingly without permission from the producer of the original articles.

In quality stationery or in quality paper for valuable documents, one effective security feature, recognizable by anyone without special devices, is the watermark which makes the contours of the selected motif and/or signum appear bright in top view (negative) and dark (positive) when viewed while held up to the light.

It is known to apply a varnish solution, containing colorants capable of migrating, onto a flat article of a synthetic resin promoting migration, and to stop such solution after reaching the desired migration depth by means of a crosslinking reaction (German Pat. No. 2,750,984). According to this process, large-area products for decorative sheeting or coverings for floor or walls, or also molded articles, are produced, in particular.

It is an object of this invention to propose a security feature for flat components of a synthetic resin, which feature, on the one hand, can be imitated or altered only with difficulties and, on the other hand, can be identified even by unskilled persons in a simple and rapid fashion.

This object has been attained advantageously by a process for producing a forgery-proof flat article from a synthetic resin by the application of colorants capable of migrating onto the surface of the article in the presence of a crosslinkable component in the article and/or in the colorant application and by the subsequent crosslinking of the crosslinkable component when the desired migration depth has been reached, with the colorant penetrating at least a part of the thickness of the flat article being set in correspondence to the selected security feature in the form of a pattern, said colorant showing the security feature in a congruent fashion on both sides of the article and by the product; i.e., flat article obtained by this process.

A coloring is obtained that passes through a part of or optionally through the entire material, this coloring showing on the front side was well as on the rear side of the flat article in congruence the selected security mark in correspondence with the applied pattern. The security feature cannot be removed, either, by scratching or scraping, or obliterated by a solvent, as would be the case with a merely imprinted pattern or in case of a signature. Furthermore, in an examination of the flat article, the migration wedge is detectable or identifiable on the lateral cutting edges in a cross section of the flat article of this invention.

An effective security feature analogous to a watermark is obtained according to the invention by using in the varnish solution, or paint solution, two colorants having differing migrating speeds, for example, a blue colorant and a yellow colorant. If the yellow colorant is the more rapidly migrating color, then, after an adequate migration period, the selected motif can be seen in yellow color on one surface of the flat article, which latter is dyed, for example, to be white or opaque. When the article is held up to the light, however, the same motif is recognizable in a dark green color. When the desired migration depth of the applied colorant has been reached in the flat article, a fixing or setting step is effected, for example, by crosslinking.

The migration depth can also be adjusted so that the motif is not recognizable in top view, but rather becomes apparent only when the article is held up to the light. Special effects are obtained if one sheet side, treated as above with a paint containing two different colorants, namely, yellow and blue, is bonded by laminating to another sheet forming a composite flat article, namely, in such a way that the applied security mark now lies between the two sheets. After the migration step, which can be accelerated by the effects of temperature, the security mark becomes visible in yellow color on both surfaces. It makes no difference now from which side the sheet is viewed, the security mark will always appear yellow when viewed from the top and green when viewed by holding the article up to the light. Such a composite flat article is illustrated in a cross-sectional view in the accompanying sole FIGURE of the drawing wherein a is a thermoplastic sheet of PVC and b is another sheet of PVC, with a printing surface 1 being formed on sheet a or b (before lamination) and with the two colorants being applied. Upon migration, zone 2 of the composite sheet is dyed with the faster migrating colorant and zone 3 of the composite sheet is dyed with a mixed color resulting from the two colorants. The cutting edge in such a composite flat article shows a blue color wedge in the center, changing via green to yellow toward the rims. By crosslinking, the contours of the color wedge are set (fixed). Besides the conventional colorants, it is also possible to employ customery organic luminescent dyes, for example:

Lumilux® Green CD 302,

Lumilux® Red CD 303,

Lumilux® White-Yellow CD 304.

However, here one is limited to the group of organic luminescent dyes capable of migrating. With these dyes, composite flat articles can be produced showing the selected security feature under normal light only when the article is held up to the light, but displaying the motif also when viewed from above in case of UV light having specific wavelengths.

Basically, it is unnecessary for both of the colorants to be capable of migrating in the production of these water mark-analogous features according to the invention. It is also possible to utilize combinations of an organic dye capable of migrating with inorganic or organic pigments showing a lack of, or very little, migrating capability.

Suitable processes for the application of the varnish paints are printing, rolling, casting, dipping, and spraying methods. However, moreover, it is also possible to provide appropriate ballpoint pen pastes, inks, water color inks, pen fillings, or the like, for the application of security markings. Thus, it would be possible to provide on the composite flat articles according to this invention lettering, notations, illustrations, or the like, which cannot be removed after fixation by crosslinking and which cannot be simply falsified, altered, or manipulated. In case of banking cards and credit cards, as well as in case of ID cards made of plastic, a safe method is, therefore, created for providing an indelible signature.

Examples 1 to 3 illustrate the technical aspects of the flat articles according to the invention, as well as the process of this invention for manufacturing the flat articles.

EXAMPLE 1

The following formulation is mixed and homogenized on a rolling mill at 130° C. for a period of 15 minutes:

150 parts by weight of S-PVC KW 60 (Vinnol H 60 D ®)

6 parts by weight of stabilizer (Irgastab 17 M ®)

0.5 parts by weight of a Paraffin as mold release agent 17 parts by weight of hexanediol diacrylate 15 parts by weight of $TiO_2$ The resultant rolled sheet is press-molded in a press at 140° C. into sheets having a thickness of 0.2 mm.

By the screen printing method, the following varnish paint is imprinted in a pattern:

120 parts by weight of screen printing varnish (colorless) Maragloss GS ®

5 parts by weight of carbon black 0.2 parts by weight of yellow azo dye (MG 253)

After drying of the varnish, a laminate is produced from this sheeting in a press at 150° C. with another unprinted sheet. In this procedure, the imprinted motif comes to be located between the two sheets. The pressing time and, thus, the residence time at 150° C. is 10 minutes.

The resultant composite sheet shows the selected motif in a yellow color.

When the article is viewed while being held up to the light, the same pattern can be discerned in black.

In cross section, a yellow color wedge can be seen at the cutting edge. The migration process is terminated by irradiation with an electron beam unit with an acceleration voltage of 500 keV. A dose of 1.5 Mrad was employed.

EXAMPLE 2

A signature is applied to the sheet of Example 1 with a ballpoint pen filled with the following paste formulation:

13 parts by weight of "Remastral" Blue 3 G ®

5 parts by weight of Fat Blue B ®

20 parts by weight of olein 32 parts by weight of benzyl alcohol 30 parts by weight Synthetic Resin SK ®

This signed sheet is exposed to a temperature of 100° C. for 15 minutes. Thereafter, the sheet is irradiated on both sides with a 250 keV electron beam unit with a dose of 2 Mrad, thus preventing further migration of the dyes. With this sheet, the signature is permanently dyed into the sheet throughout its entirety. On the rear, the signature is visible in a mirror image.

This signature cannot be removed without destruction of the sheet; this would be possible, for example, in case of a normal ballpoint pen paste by wiping off with a suitable solvent.

Also impossible would be removal by scratching or scraping.

EXAMPLE 3

A sheet according to Example 1 is provided with a design using the following color solution by means of the screen printing process:

16 parts by weight of screen printing varnish (colorless) Maragloss GS ®

0.35 parts by weight of carbon black 0.40 parts by weight of "Lumilux" Green CD 302 ®

Lamination is performed as described in Example 1.

The sheet is crosslinked by a dose of 2 Mrad in a 500 keV electron beam unit.

The resultant sheet is monochromatic-white under normal light. Only when viewed under UV light, the previously applied motif becomes visible. When viewing the sheet while holding it up to the light, this motif can be seen under normal as well as UV light.

What is claimed is:

1. A process for the production of forgery-proof flat articles with security features analogous to watermarks from at least one synthetic resin transparent, translucent, or colored sheet, which comprises applying at least two different colorants, at least one of which is capable of quickly migrating, onto the surface of a sheet of the flat article formed of synthetic resin in the presence of a crosslinkable component in the flat article and/or in the colorant application, and subsequently crosslinking the crosslinkable component when the desired migration depth has been reached for the applied colorant in the flat article, the at least one migrating colorant penetrating at least a part of resin material of the flat article being fixed by crosslinking in corresponding with the selected security feature in the form of a pattern, motif, or lettering, said colorants providing a security feature in a congruent fashion on both sides of the flat article; said composite flat article being produced by laminating a first sheet with a second sheet made of the same synthetic resin material as the first sheet, and the colorants being applied to one of the sheets so that color application lies between the two sheets, a migration of the at least one migrating colorant taking place into both sheets; the faster migrating colorant being an organic luminescent dye, whereby the security feature selected can be discerned under normal light only when the article is held up to the light but, in case of UV light of specific wavelengths, the security feature can also be recognized in a top view of the article.

2. A process according to claim 1, wherein two differently quickly migrating colorants are applied to provide sharp contrast in correspondence to the security feature selected.

3. A process according to one of claims 1 and 2, wherein the migration depth is adjusted so that the security feature is not discerned in a top viewing of the flat article and the security feature is discerned when viewed while the article is held up to the light.

4. A process according to claim 1, wherein said at least one migrating colorant is blended with ballpoint pen paste, ink, water color ink, filling, or the like.

5. A forgery-proof flat article with watermark-analogous security features comprising at least one synthetic resin transparent, translucent, or colored sheet and two different colorants, at least one of which is a quickly migrating colorant, applied to the surface of a synthetic resin sheet of the flat article in the presence of a crosslinkable component in the flat article and/or in the colorant application, said at least one quickly migrating colorant being fixed upon reaching the desired migration depth in the flat article, and said flat article exhibiting a coloration, penetrating at least a part of synthetic resin material of the flat article, corresponding to the security feature selected, this coloration providing a security feature in congruence on both sides of the flat article; the applied colorant lying between two sheets and migration and subsequent fixation of the security feature being effected into and within both sheets of a composite flat article; said quickly migrating dye being an organic luminescent dye, the security feature being recognizable under normal light only when viewed while being held up to the light, but in the case of UV light of specific wavelengths being also recognizable when viewed from above.

6. A flat article according to claim 5, wherein two differently quickly migrating colorants are applied together, the security feature appearing on the topside of the flat article in the color of the more quickly migrating colorant and, the security feature when viewed while the article is held up to the light, appearing in a mixed color.

7. A flat article according to claim 5, wherein the security feature is not recognizable in a top view, but only when viewing the article while held up to the light.

8. A flat article according to claim 5, wherein the security feature is applied by means of migratable, colorant-containing ballpoint pen pastes, inks, water color inks, or the like.

* * * * *